US010801193B2

(12) United States Patent
Şimşir et al.

(10) Patent No.: US 10,801,193 B2
(45) Date of Patent: Oct. 13, 2020

(54) CONTROL SYSTEM FOR THE FLUSHING SYSTEMS AND METHOD OF OPERATION FOR THE SAME

(71) Applicant: ECZACIBASI YAPI GEREÇLERI SANAYI VE TICARET ANONIM SIRKETI, Istanbul (TR)

(72) Inventors: Boğaç Şimşir, Istanbul (TR); Fatih Gerenli, Istanbul (TR); Sefa Hazir, Istanbul (TR)

( * ) Notice: Subject to any disclaimer, the term of this patent is extended or adjusted under 35 U.S.C. 154(b) by 0 days.

(21) Appl. No.: 16/465,487

(22) PCT Filed: Dec. 13, 2017

(86) PCT No.: PCT/TR2017/050658
§ 371 (c)(1),
(2) Date: May 30, 2019

(87) PCT Pub. No.: WO2018/199869
PCT Pub. Date: Nov. 1, 2018

(65) Prior Publication Data

US 2019/0368174 A1 Dec. 5, 2019

(30) Foreign Application Priority Data

Dec. 21, 2016 (TR) ..... a 2016 19160

(51) Int. Cl.
*E03C 1/05* (2006.01)
*E03D 5/10* (2006.01)

(52) U.S. Cl.
CPC ..... *E03C 1/055* (2013.01); *E03D 5/105* (2013.01)

(58) Field of Classification Search
CPC ..... E03C 1/055
USPC ..... 4/313
See application file for complete search history.

(56) References Cited

FOREIGN PATENT DOCUMENTS

| | | | |
|---|---|---|---|
| EP | 1258569 | A2 | 11/2002 |
| WO | 2006042053 | A2 | 4/2006 |
| WO | 2010049913 | A2 | 5/2010 |

OTHER PUBLICATIONS

Written Opinion of the ISA & International Search Report related to PCT/TR2017/050658, dated Dec. 27, 2018.

*Primary Examiner* — Lori L Baker
(74) *Attorney, Agent, or Firm* — Egbert Law Offices, PLLC

(57) ABSTRACT

A control system provided is suitable for use in the automated and/or digitized flushing systems with at least one reservoir for the collection of the water to be used in cleaning the toilet bowl, wherein the discharge of the water is realized automatically by at least one sensor and/or digitally by a discharge button operating in a touch-operated manner, and the control system has—a normal mode in which the water is discharged every time the discharge button and/or the sensor is/are triggered and a locking mode in which the discharge of the water within the reservoir is prevented every time the discharge button and/or the sensor is/are triggered. Owing to the control system and the method of operation disclosed herein, it is possible to regulate the operation of a flushing system according to need.

19 Claims, 1 Drawing Sheet

CONTROL SYSTEM FOR THE FLUSHING SYSTEMS AND METHOD OF OPERATION FOR THE SAME

RELEVANT TECHNICAL FIELD

The present invention relates to the control systems that enable the flushing systems to be controlled in an automated and/or digitized manner and to the methods of operation for the same.

PRIOR ART

Various flushing systems are used in the toilets for providing the cleanliness and hygiene of the toilet bowls. Said flushing systems comprise one or more reservoir for the storage of the water used in cleaning and one or more control member for the delivery of the water within the reservoir into the toilet bowl. Although it is possible for said reservoir to be positioned visibly inside a toilet, the reservoir is positioned as embedded inside a wall of the toilet and said control member is present on the wall, according to the common practice of the present. Said flushing systems operate manually and the discharge of the water within the reservoir is left to the discretion of the user. Moreover, since the user has to contact the control member in the systems with manual operation, the problems with hygiene could arise particularly in the public toilets. In this context, the flushing systems, which automatically perform the action of discharging the reservoir by means of the sensor(s), are recently employed in place of the manually operating flushing systems. The action of discharge of the reservoir in such flushing systems may be realized by means of the user placing an object (for example his/her hand) within the sensing zone of a sensor. According to another practice, the flushing systems, which detect the presence of a user and enable the reservoir to be discharged while the user is leaving the toilet, are employed as described in the document JP2002266405A. However, when the toilets comprising the automated and/or digitized flushing systems that operate either in a touch-operated manner or in a non-contact manner are used by the children, the reservoir could be unnecessarily emptied for several times, which could in turn lead to a significant consumption of water.

BRIEF DESCRIPTION OF THE INVENTION

The control system developed according to the present invention is suitable for use in the automated and/or digitized flushing systems with at least one reservoir for the collection of the water to be used in cleaning the toilet bowl wherein the discharge of the water within the reservoir is realized automatically by means of at least one sensor and/or digitally by means of a discharge button operating in a touch-operated manner, and said control system comprises a normal mode in which the water within the reservoir is discharged every time the discharge button and/or the sensor is/are triggered and a locking mode in which the discharge of the water within the reservoir is prevented every time the discharge button and/or the sensor is/are triggered and said control system further comprises at least one control panel including a control unit for regulating said normal mode and locking mode and at least one lock button, which is located in said control panel, is linked to the control unit such that it may perform the data exchange and enables the switching into the locking mode or the normal mode by transmitting the data to the control unit in accordance with the need of the user.

Owing to the control system and the method of operation developed according to the present invention, it is possible to regulate the operation of a flushing system according to need. In this regard, it becomes possible to reduce the consumption of water by way of preventing the unnecessary use of the flushing system especially by the children, owing to the use of the lock button.

OBJECT OF THE INVENTION

An object of the present invention is to devise a control system for the automated and/or digitalized flushing systems in the toilets and a method of operation for said system.

Another object of the present invention is to devise a control system whereby the uncontrolled use of the automated and/or digitalized flushing systems by the children is prevented and a method of operation for said system.

DESCRIPTION OF THE FIGURES

The representative embodiments of the control system and the method of operation developed according to the present invention are shown in the accompanying drawings in which.

Figure 1:
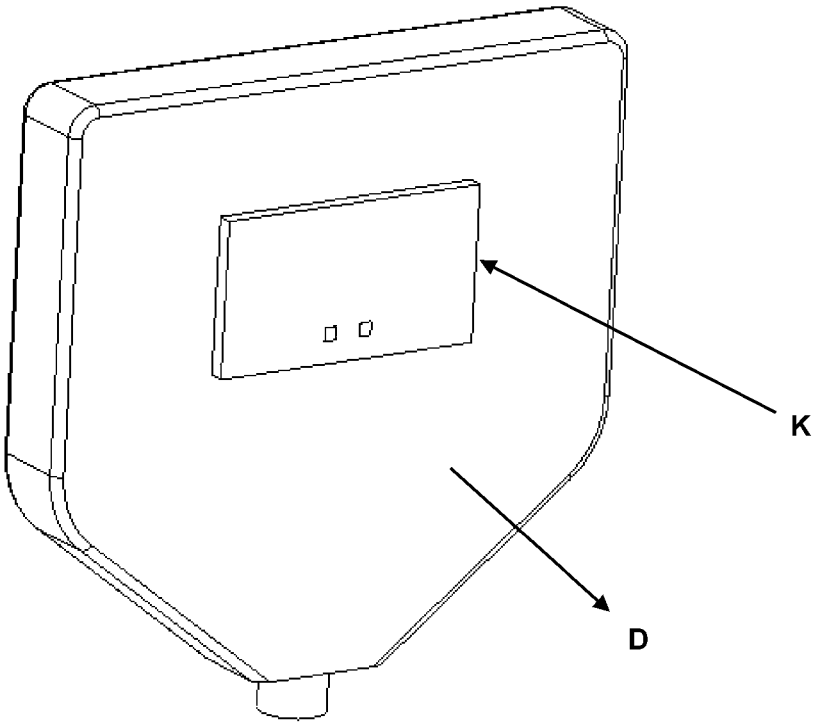
FIG. 1 is a perspective view of an embodiment of the control system developed.
Figure 2:
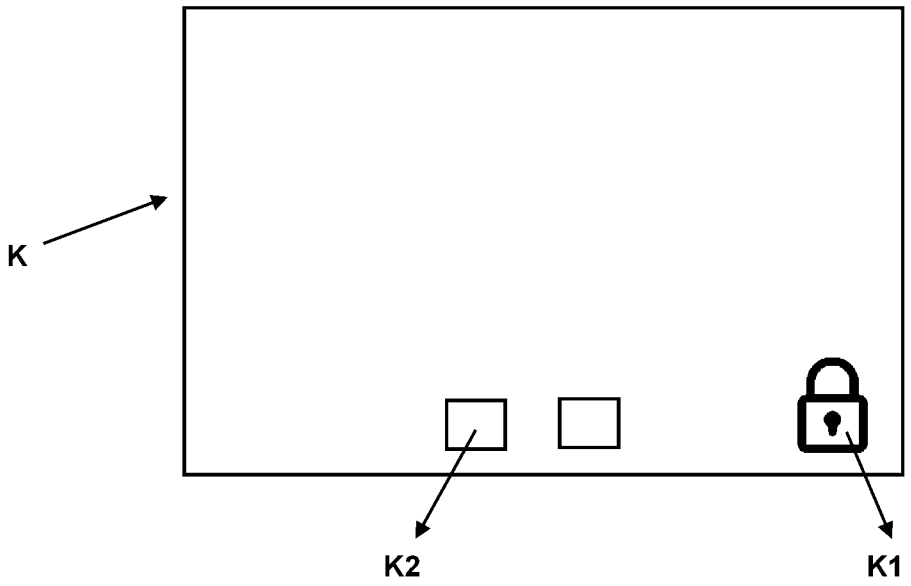
FIG. 2 is an exemplary illustration of a control panel that the developed control system comprises.

The parts in the figures are individually assigned with reference numerals and the designations for the reference numerals are provided below:

| | |
|---|---|
| Control panel | (K) |
| Lock button | (K1) |
| Main button | (K2) |
| Reservoir | (D) |

DESCRIPTION OF THE INVENTION

The cleaning of the toilet bowls following the use thereof is carried out via various flushing systems comprising at least one reservoir for the storage of the water to be used in cleaning. Although the transfer of the water within said reservoir into the toilet bowl is performed by means of mechanical discharge buttons, it is also possible to achieve the same via a control system. In such automated and/or digitized flushing systems, the discharge of the water within the reservoir by means of the control system may be performed in a touch-operated manner or in a non-contact manner. However, particularly such automated and/or digitized structures are very susceptible to unnecessary use by the children and could lead to the occurrence of an undue consumption of water. In this regard, a control system for the automated and/or digitalized flushing systems in the toilets and a method of operation for said system are developed according to the present invention.

As shown in FIG. 1, the control system developed according to the present invention is suitable for use in the automated and/or digitized flushing systems with at least one reservoir (D) for the collection of the water to be used in cleaning the toilet bowl wherein the discharge of the water within the reservoir is realized automatically by means of at least one sensor and/or digitally by means of a discharge button operating in a touch-operated manner (e.g. a touch-operated button or a button for sending digital data via mechanical action), and said control system comprises a normal mode in which the water within the reservoir (D) is discharged every time the discharge button and/or the sensor is/are triggered and a locking mode in which the discharge of the water within the reservoir (D) is prevented every time the discharge button and/or the sensor is/are triggered and said control system further comprises at least one control panel (K) including a control unit (e.g. a processor) for regulating said normal mode and locking mode and at least one lock button (K1), which is located in said control panel (K), is linked to the control unit such that it may perform the data exchange and enables the switching into the locking mode or the normal mode by transmitting the data to the control unit in accordance with the need of the user. According to a representative embodiment of the invention, when a user wants to use a flushing system, which is currently operating in the normal mode, in the locking mode, he/she triggers said lock button (K1) (said triggering action may be achieved by way of touching or by way of bringing an object near the lock button (K1) [in other words, by way of bringing said object within a predetermined distance from the lock button (K1)]) and said triggering action is detected by the control unit to enable the flushing system to switch into the locking mode. Similarly, when it is desired to switch from the locking mode into the normal mode, the lock button (K1) is again triggered and said switching is provided by means of said control unit.

According to alternative embodiments of the invention, said lock button (K1) may be a button that is triggered by way of contact; however, it is also possible for said button to be a button that is triggered via mechanical action (and that preferably sends a digital triggering data to the control unit) or a button that is triggered in a non-contact manner upon an object being positioned within a predefined distance from the same (a button that operates based on the sensor logic).

According to another preferred embodiment of the invention, the control system comprises at least one main button (K2) by means of which the operation of the lock button (K1) is controlled and regulated. In this embodiment, the lock button (K1) accordingly has an active mode in which it carries out the exchange of data with the control unit and a passive mode in which the exchange of data with the control unit is prevented, and the lock button (K1) preferably runs in the passive mode as default. When it is desired to switch between the modes, first said main button (K2) is triggered and the lock button (K1) is enabled to switch into the active mode. Afterwards, the lock button (K1) may be triggered to achieve the switch from the normal mode into the locking mode or from the locking mode into the normal mode. In this way, the lock button (K1) may be prevented from being inadvertently triggered to thereby avoid the uncontrolled change in the mode of the flushing system.

According to another representative embodiment of the invention, the control system developed preferably comprises at least one visual warning member for informing the currently active mode of the flushing system to a user. Said visual warning member preferably comprises at least one illuminating member (e.g. LED) and preferably illuminates said lock button (K1) continuously and/or intermittently depending on the currently active mode. For example, when the locking mode is active, the illuminating member illuminates the lock button (K1) in green color, whereas it does not illuminate the lock button (K1) or it enables the lock button (K1) to be illuminated in a different color (for example in red color) when the normal mode is active.

According to another alternative embodiment of the invention, the control system comprises at least one wireless communication unit (such as Bluetooth) capable of communicating and performing data exchange with a remote device (e.g. a phone). In this way, it may be possible to inform the user in an instantaneous manner about the operating status of the flushing system and to perform a notification for the user about the situation for example in case the discharge button and/or the sensor is/are triggered when the locking mode is currently active.

The method of operation developed according to the present invention is suitable for use in the automated and/or digitized flushing systems comprising said control system and at least one reservoir (D) for the collection of the water to be used in cleaning the toilet bowl wherein the discharge of the water within the reservoir is realized automatically by means of at least one sensor and/or digitally by means of a discharge button operating in a touch-operated manner (e.g. a touch-operated button or a button for sending digital data via mechanical action) and said method comprises the steps of first bringing, by way of the main button (K2) being triggered by the user, the lock button (K1) into the state where it is capable of transmitting data to the control unit; then the user triggering the main button (K2) for a first predetermined duration (for example, the user holding down the main button (K2)), and in the meantime, the user triggering also the lock button (K1) for a second predetermined duration (for example, the user holding down the lock button (K1)); and performing the change in the mode by way of switching from one mode into another at the end of said second duration. Although said first duration and/or second duration is/are preferably in the range of 1 to 10 seconds, it is possible to set such duration preferably to 3 seconds.

According to another alternative embodiment of the invention, the method of operation developed further comprises the steps of counting, by means of the control unit, the number of times the discharge button and/or the sensor has/have been triggered within a predetermined duration (for example within a duration in the range of 1 second to 300 seconds, preferably within a duration of 60 seconds) and comparing said number to a predefined number of triggering actions, identifying the current situation as the unnecessary use of the flushing system in case the number of triggering actions is greater than the predefined number and switching into the locking mode. In this way, it becomes also possible to achieve the control over the flushing system in a manner independent from the user and to instantly intervene with the situations of unnecessary use to thereby preclude the unnecessary consumption of water. According to this embodiment, the switch from the locking mode into the normal mode may preferably be performed in a manner that involves first bringing, by way of the main button (K2) being triggered by the user, the lock button (K1) into the state where it is capable of transmitting data to the control unit; then the user triggering the main button (K2) for a first predetermined duration (for example, the user holding down the main button (K2)), and in the meantime, the user triggering also the lock button (K1) for a second predetermined duration (for example, the user holding down the lock button (K1)); and performing the change in the mode by way of switching from the locking mode into the normal mode at the end of said second duration. Owing to the control system and the method of operation developed according to the present invention, it is possible to regulate the operation of a flushing system according to need. In this regard, it becomes possible to reduce the consumption of water by way of preventing the unnecessary use of the flushing system especially by the children, owing to the use of the lock button (K1).

The invention claimed is:

1. A control system for use in automated or digitized flushing system, the control system comprising:

at least one reservoir for collection of water used in cleaning a toilet bowl;

a trigger cooperative with the at least one reservoir, the trigger having a normal mode and a locking mode, the normal mode discharging water from the at least one reservoir when said trigger is triggered, the locking mode preventing the discharge of the water from the at least one reservoir when said trigger is triggered, said trigger being at least one sensor or a discharge button;

at least one control panel having a control unit cooperative with said trigger so as to cause said trigger to be in the normal mode or the locking mode; and at least one lock button positioned in said at least one control panel and locked to said at least one control panel so as to exchange data therewith so that said at least one lock button switches between the locking mode or the normal mode by transmitting the data to the control unit.

2. The control system of claim 1, wherein said at least one lock button is a touch-triggered button.

3. The control system of claim 1, wherein said at least one lock button is a non-contract proximity-actuated button.

4. The control system of claim 1, wherein said at least one lock button is mechanically-triggered button.

5. The control system of claim 4, wherein said at least one lock button transmits digital triggering data to the control unit.

6. The control system of claim 1, wherein said at least one lock button has an active mode and a passive mode, the active mode exchanging data with the control unit, the passive mode preventing exchange of data with the control unit.

7. The control system of claim 6, further comprising:

at least one main button cooperative with said at least one lock button so as to control an operation of said at least one lock button so as to switch said at least one lock button between the active mode and the passive mode.

8. The control system of claim 1, further comprising:

at least one visual warning member cooperative with the control unit and adapted to provide a visual signal as to a use of an active mode of the flushing system.

9. The control system of claim 8, wherein at least one visual warning member is at least one illuminating member.

10. The control system of claim 9, wherein said at least one illuminating member is an LED.

11. The control system of claim 9, wherein said at least one illuminating member cooperates with said at least one lock button so as to illuminate said at least one locking button continuously or intermittently.

12. The control system of claim 1, further comprising:

at least one wireless communication unit cooperative with the control unit so as to communicate and exchange data with a remote device.

13. A method of operating a control system of claim 7, comprising:

bringing the at least one lock bolt into a state wherein the lock button transmits data to the control unit by triggering the at least one main button by a user;

triggering the at least one main button for a first predetermined duration and simultaneously triggering the at least one lock button for a second predetermined duration; and switching between the active mode or passive mode at an end of the second predetermined duration.

14. The method of claim 13, wherein the first predetermined duration is between 1 and 10 seconds.

15. The method of claim 13, wherein the first predetermined duration is 3 seconds.

16. The method of claim 13, wherein the second predetermined duration is between 1 and 10 seconds.

17. The method of claim 13, wherein the second predetermined duration is 3 seconds.

18. The method of claim 13, further comprising:

counting by the control unit a number of times the trigger has been triggered within one of the first predetermined duration or the second predetermined duration;

comparing the counted number or times to a predefined number of triggering actions;

identifying a situation wherein the counted number of times is greater than the predetermined number; and automatically switching to the locking mode.

19. A method of operating the control system of claim 1, comprising:

counting by the control unit a number of times the trigger has been triggered within a predetermined duration;

comparing the counted number with a predefined number of triggering actions;

identifying a current situation where the counted number is greater than the predefined number of triggering actions; and automatically switching the trigger to the locking mode by using the control unit.

* * * * *